US008754352B2

(12) United States Patent
Pietrzak et al.

(10) Patent No.: US 8,754,352 B2
(45) Date of Patent: Jun. 17, 2014

(54) COMPRESSION SPRING WING DEPLOYMENT INITIATOR

(75) Inventors: Amy Pietrzak, Londonderry, NH (US); Michael J. Krueger, Bedford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 358 days.

(21) Appl. No.: 13/376,747

(22) PCT Filed: Apr. 4, 2011

(86) PCT No.: PCT/US2011/031074

§ 371 (c)(1), (2), (4) Date: Dec. 7, 2011

(87) PCT Pub. No.: WO2011/126970

PCT Pub. Date: Oct. 13, 2011

(65) Prior Publication Data

US 2012/0074256 A1 Mar. 29, 2012

Related U.S. Application Data

(60) Provisional application No. 61/321,654, filed on Apr. 7, 2010.

(51) Int. Cl.
*F42B 15/01* (2006.01)

(52) U.S. Cl.
USPC ..... 244/3.28

(58) Field of Classification Search
USPC ..... 244/3.24, 3.27, 3.28, 49
See application file for complete search history.

(56) References Cited

U.S. PATENT DOCUMENTS

| | | | | |
|---|---|---|---|---|
| 3,861,627 | A * | 1/1975 | Schoffl | 244/3.27 |
| 3,918,664 | A * | 11/1975 | Grosswendt | 244/3.28 |
| 3,921,937 | A * | 11/1975 | Voss et al. | 244/3.27 |
| 5,240,203 | A * | 8/1993 | Myers | 244/3.28 |
| 6,880,780 | B1 * | 4/2005 | Perry et al. | 244/3.27 |
| 8,324,544 | B2 * | 12/2012 | Palani et al. | 244/3.24 |
| 8,415,598 | B1 * | 4/2013 | Terhune et al. | 244/3.28 |
| 2005/0082420 | A1 * | 4/2005 | Trouillot | 244/3.28 |
| 2009/0127378 | A1 * | 5/2009 | Turner et al. | 244/3.27 |

* cited by examiner

*Primary Examiner* — Tien Dinh
(74) *Attorney, Agent, or Firm* — Maine Cernota & Rardin; Douglas P. Burum

(57) ABSTRACT

A wing deploy initiator for deploying guidance wings of a rocket or missile, such as the APKWS, provides enhanced wing deploy performance with reduced complexity, cost, and likelihood of failure. The invention includes a cam which is driven between the stowed guidance wings by at least one compression spring, thereby forcing the guidance wings outward through slots in the fuselage of the rocket or missile. Oblique flat sides of the cam can push against beveled edges on the wings. The cam can be attached to spring mandrels, and the cam and mandrels can pass through a retaining plate as the springs decompress. Embodiments can exert sufficient push force to enable the wings to break through frangible slot covers. An embodiment applicable to the APKWS includes only 13 parts, and can exert up to 10 lb push force on each wing after 0.3 inches of wing travel.

12 Claims, 26 Drawing Sheets

Detail M

Detail V

COMPRESSION SPRING WING DEPLOYMENT INITIATOR

RELATED APPLICATIONS

This application claims the benefit of U.S. Provisional Application No. 61/321,654, filed Apr. 7, 2010, herein incorporated by reference in its entirety for all purposes.

FIELD OF THE INVENTION

The invention relates to ballistic weaponry, and more particularly to apparatus for deploying guidance wings on folding fin aerial rockets and missiles.

BACKGROUND OF THE INVENTION

Aerial rockets and missiles which include folded, deployable guidance wings have been in use at least since the late 1940's, with the FEAR (Folding Fin Aerial Rocket) being used in the Korean and Vietnam conflicts, and the more recent Hydra 70 family of WAFAR (Wrap-Around Fin Aerial Rocket) and Advanced Precision Kill Weapon System (APKWS) laser guided missile. For many such weapons, the guidance wings are folded in a stowed configuration within the main fuselage until the weapon is launched, at which point the wings deploy outward through slots provided in the fuselage.

Typically, a rocket or missile is spun during its flight for increased accuracy and stability. For many missiles and rockets with folded, deployable guidance wings, the guidance wings are released from their folded and stowed configuration upon launch, and are deployed by the centrifugal force which results from the spinning of the weapon in flight. In some cases, the wing slots are covered by frangible seals which protect the interior of the missile from moisture and debris during storage, transport, and handling. In these cases the guidance wings must be deployed with sufficient initial force to enable them to penetrate the seals.

Clearly, wing deployment through frangible cover seals becomes more dependable as the initial deployment force is increased. However, there is a practical limit to how rapidly a missile can be spun. In one example, the average centrifugal force on the tip of a guidance wing at the beginning of deployment is only approximately 7.7 pounds at the minimum spin rate. This amount of centripetal energy may not be sufficient by itself to enable the wings to burst through the frangible slot covers. As a result, some weapons that include deployable folded guidance wings and frangible wing slot covers have demonstrated a tendency for the guidance system to fail due to a lack of proper guidance wing deployment. This problem can be addressed by a wing deployment initiator, which assists the deployment of the guidance wings by providing an initial burst of energy to help the wings break through the frangible covers.

In some designs, the wing deployment initiator uses explosives to push the wings through the frangible covers. However, this approach can be undesirable due to the violent forces produced by the explosives, and due to concerns about the safety and the long-term chemical stability of the explosives during storage of the weapon.

A torsion spring wing deploy initiator is described in co-pending patent application 61/322,461, filed Apr. 9, 2010, of which the inventors of the current invention are co-inventors. This approach avoids the problems of using explosives. However, the deploy assist mechanism of co-pending patent application 61/322,461 is somewhat bulky and complex, since it includes 65 machined hardware parts and 8 torsion springs. For certain applications, a more compact and less complex solution would be desirable, since the reduced complexity would lower the cost of production and would decrease the likelihood of failure if the mechanism did not perform as intended.

What is needed, therefore, is a mechanical wing deploy initiator with reduced bulk and reduced complexity in comparison to current designs and in comparison to co-pending application 61/322,461.

SUMMARY OF THE INVENTION

The present invention is a mechanical compression spring wing deploy initiator for guidance wings included in rockets and missiles, in particular the Advanced Precision Kill Weapon System (APKWS) laser guided missile. The invention provides enhanced wing deploy performance with reduced complexity, cost, and likelihood of failure, as compared to previous designs.

The invention uses one or more compression springs to drive a cam between the stowed guidance wings, thereby forcing the guidance wings outward through the frangible covers of the wing deployment slots. Several advantages are realized by the present design as compared to the co-pending torsion spring mechanism:

- The deployment force is delivered by linear compression springs, which provide considerably more energy than torsion springs of similar size and weight. The present design thereby provides more deployment energy than the co-pending design, while using fewer and smaller springs.
- The deployment force in the present design is delivered to all of the guidance wings by a single cam, thereby reducing the number of parts, the complexity, and the bulkiness of the wing deploy initiator as compared to the co-pending torsion spring design, which provide separate, dedicated springs and lever arms for each wing.
- The deployment force is delivered at or near the ends of the guidance wings, thereby providing greater leverage than the co-pending torsion spring design, which applies force along the lengths of the wings.

In an embodiment directed to the APKWS, only 13 parts are required, including a cam, a cam mount, an aft retainer assembled from a plate and two inserts, four compression springs, and four corresponding mandrels. This embodiment can exert 10 lb of push force on each wing after 0.3 inches (2.5 degrees) of wing travel from its stowed position. By comparison, the APKWS embodiment of the co-pending torsion spring design includes 65 components, and can exert only between 6 and 7 pounds of push force on each wing after 0.3 inches (2.5 degrees) of wing travel from its stowed position.

The present invention is a wing deploy initiator for initiating deployment from a stowed configuration of a plurality of guidance wings of a rocket or missile, the guidance wings being hinged at distal ends thereof so as to pivot outward during wing deployment through corresponding wing slots provided in a fuselage of the rocket or missile, proximal ends of the guidance wings being located in mutual proximity within the fuselage when the guidance wings are in the stowed configuration. The wing deploy initiator includes a cam, the cam being too large to pass between the guidance wings when the guidance wings are in the stowed configuration, and at least one compression spring, the compression spring being configured to drive the cam distally between the guidance wings, the cam thereby forcing the guidance wings to pivot apart from each other and outward through the wing slots.

In various embodiments, the cam includes a plurality of flat surfaces oriented at oblique angles relative to a longitudinal axis of the rocket or missile, the flat surfaces being oriented so that each of the flat surfaces maintains contact with a corresponding one of the guidance wings as the cam is driven distally between the guidance wings. In some of these embodiments, the flat surfaces of the cam are configured so as to be substantially parallel to beveled edges provided on the corresponding guidance wings, the flat surfaces of the cams thereby making parallel contact with the beveled edges of the corresponding guidance wings as the cam is driven distally between the guidance wings.

In certain embodiments, each of the compression springs surrounds a mandrel and is retained between a distal end of the mandrel and a retainer plate, a proximal end of the mandrel being able to pass through an opening in the retainer plate so as to compress the compression spring against the retainer plate, the cam being attached to the plurality of mandrels. In some of these embodiments, the cam is attached to the mandrels near the proximal ends of the mandrels. In some of these embodiments the cam is able to pass through an opening in the retainer plate as the proximal ends of the mandrels pass through the retainer plate. And some of these embodiments further include a cam mount attaching the cam to the proximal ends of the plurality of mandrels, the cam mount being unable to pass fully through the retainer plate, the cam mount thereby preventing removal of the mandrels from the retainer plate.

In various embodiments the guidance wings are maintained in the stowed configuration by a wing retaining mechanism, the guidance wings thereby preventing the distal movement of the cam until the wing retaining mechanism is released so that the guidance wings can be driven outward by the distal movement of the cam.

In certain embodiments the wing deploy initiator is configured for use with an APKWS missile. In some embodiments the wing deploy initiator consists of a total of 13 parts. In other embodiments the wing deploy initiator is able to exert at least 10 lb of push force on each wing after 0.3 inches (2.5 degrees) of wing travel from each wing's stowed position. And in still other embodiments the wing deploy initiator is able to exert sufficient push force on each wing to cause each wing to break through a frangible cover installed over the corresponding wing slot.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a non-explosive compression spring driven wing deploy initiator for guidance wings included in rockets and missiles, in particular the Advanced Precision Kill Weapon System (APKWS) laser guided missile. The invention provides enhanced wing deploy performance with reduced complexity, cost, and likelihood of failure.

Figure 1:
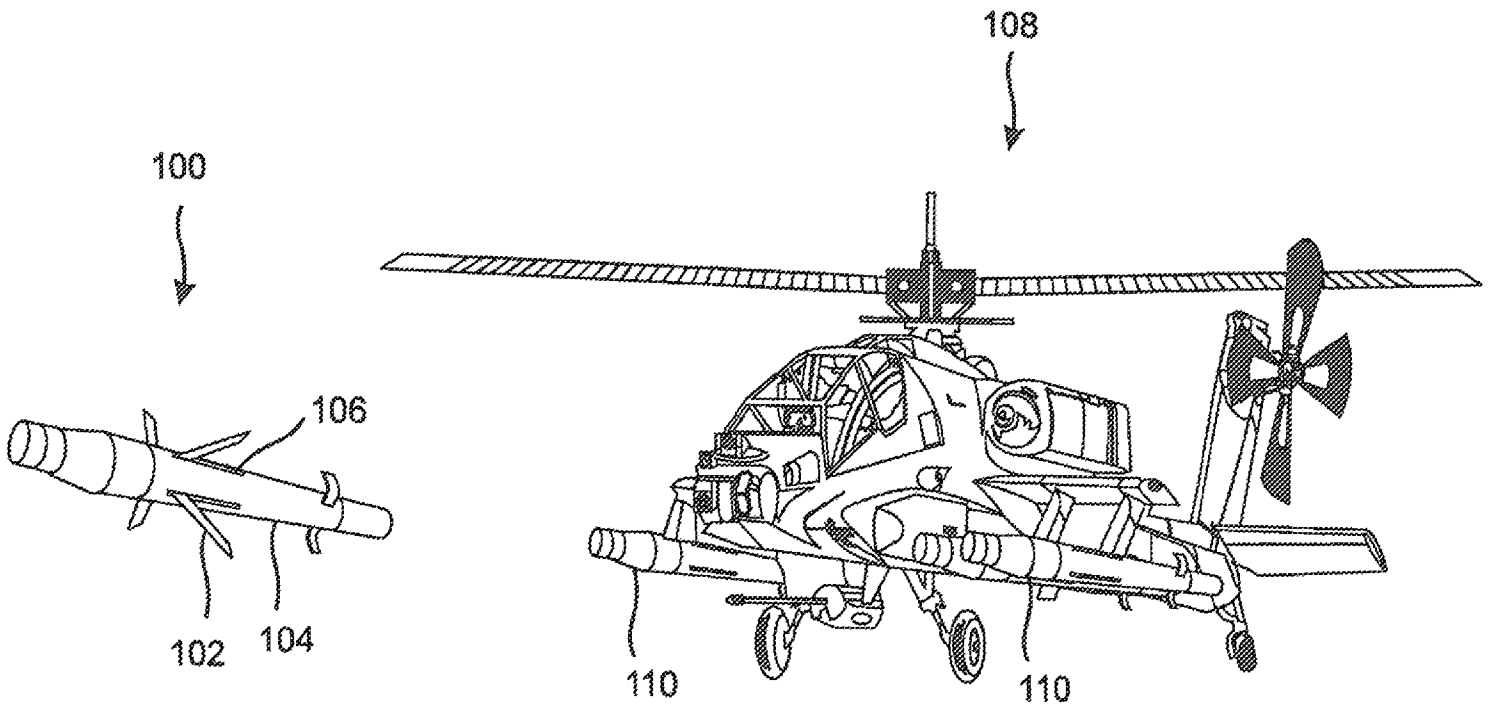
FIG. 1 is a perspective view of an APKWS having just been launched from a helicopter, showing its guidance wings deployed.

With reference to FIG. 1, some aerial rockets and missiles 100 include guidance wings 102 which are typically folded within the main fuselage 104 in a stowed configuration until the weapon is launched, at which point the wings 102 are released and deployed through wing slots 106. One example is the Advanced Precision Kill Weapon System (APKWS) laser guided missile 100. FIG. 1 illustrates an APKWS 100 having just been launched from a helicopter 108, with its guidance wings 102 deployed. Additional APKWS missiles 110 are shown still attached to the helicopter 108 with their guidance wings not yet deployed. The wing slots 106 in these missiles 110 are covered by frangible covers, which protect the interior of the missile from dirt and debris before launch. Deployment of the guidance wings 102 therefore requires that the wings 102 break through the frangible covers.

Some weapons that include guidance wings have demonstrated a tendency for the guidance system to fail due to a failure of the guidance wings to break through the frangible wing covers, and a resultant lack of proper wing deployment. This problem has been addressed in some designs by explosive deployment mechanisms. However, the sudden, violent force delivered by such mechanisms is not optimal, and safety and long term chemical stability of the explosives are a concern.

Figure 2:
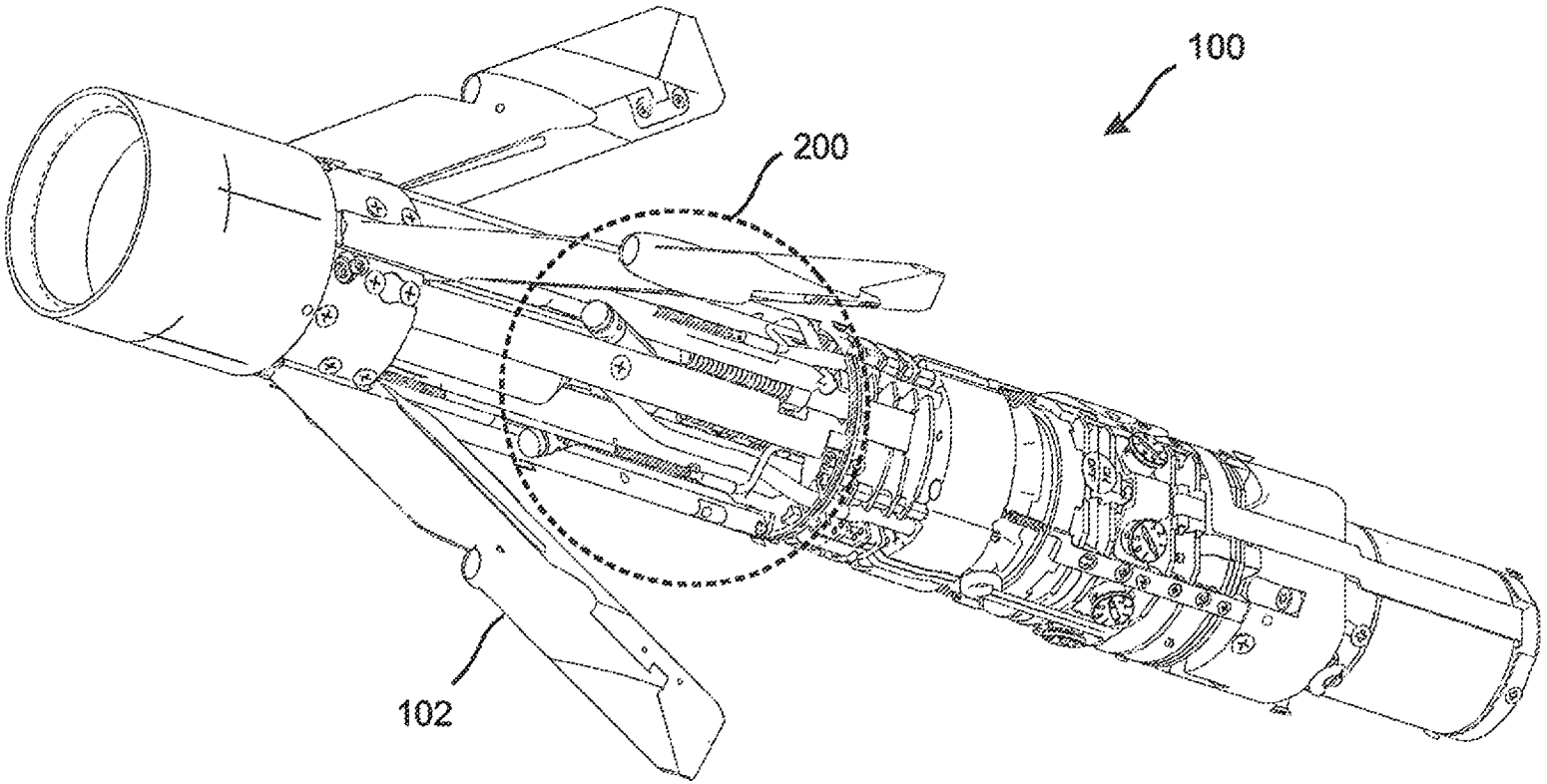
FIG. 2 is a perspective view showing the location of the guidance wing storage region of the present invention in an APKWS missile.

The present invention addresses the problem of guidance wing deployment through a frangible cover by providing a compression spring wing deploy initiator which assists in the bursting of the guidance wings through the frangible wing slot covers. FIG. 2 illustrates the installation location 200 of an embodiment of the present invention in an APKWS missile 100.

Figure 3B:
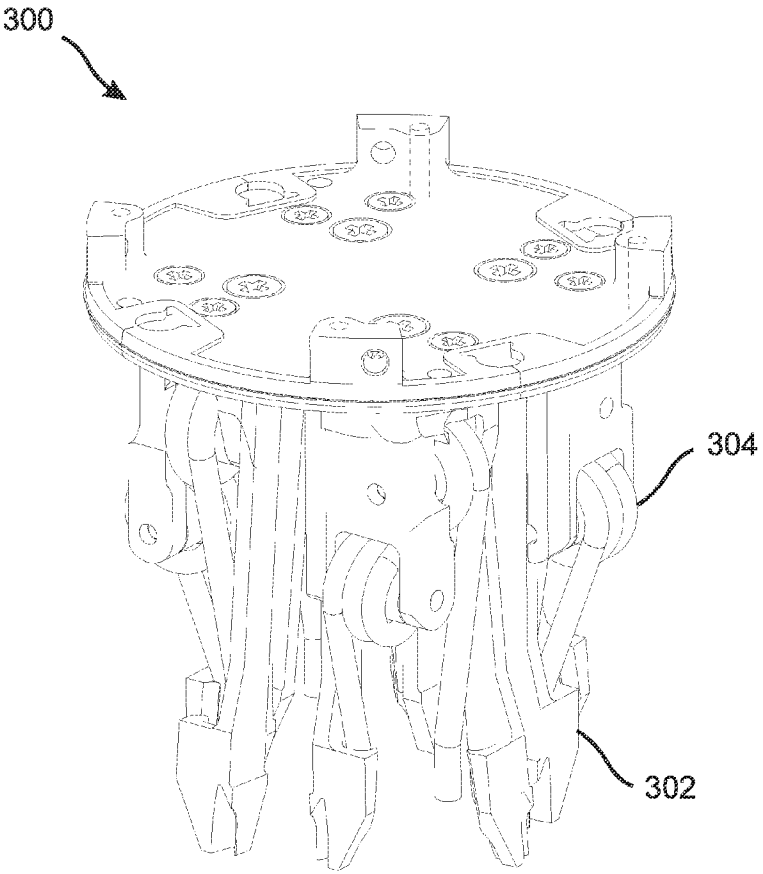
Figure 3B Prior Art
FIG. 3B is a perspective view from above of the mechanism of the torsion spring wing initiator of co-pending patent application 61/322,461.
Figure 3A:
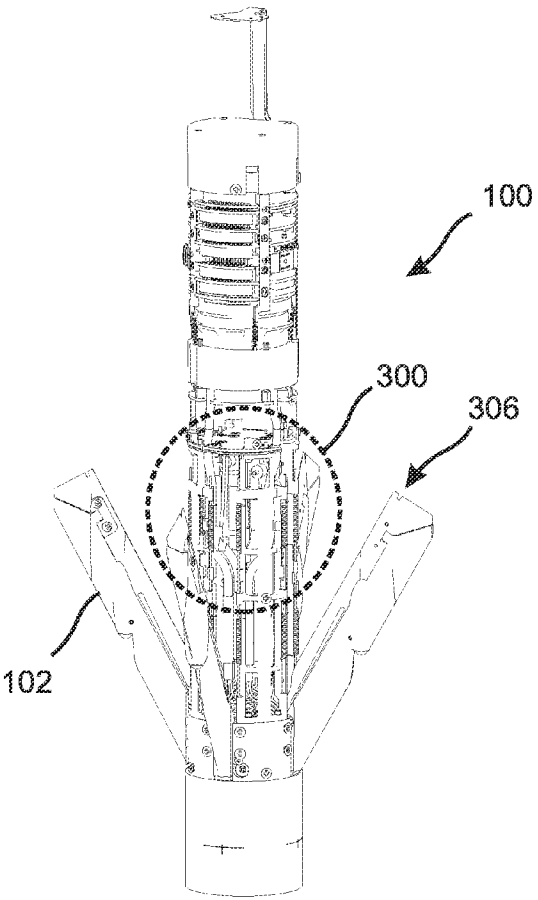
Figure 3A Prior Art
FIG. 3A is a perspective view showing the location of the wing deploy initiator of co-pending patent application 61/322,461 in an APKWS missile.

FIG. 3A is a perspective view of an APKWS missile 100 in which a torsion spring wing deployment initiator 300 has been installed. The torsion spring initiator 300 is described in more detail in co-pending patent application 61/322,461, filed Apr. 9, 2010, of which the inventors of the current invention are co-inventors.

With reference to FIG. 3B, the torsion spring wing deploy initiator 300 of co-pending application 61/322,461 includes 65 machined/hardware parts, including 8 lever arms 302 and 8 torsion springs 304, whereby each lever arm 302 is driven by a torsion spring 304 and each wing 102 is pushed by two lever arms 302 to initiate its deployment. Before deployment, the wings 102 are locked in their stowed position by tabs in an aft retainer plate which engage with notches 306 provided in the wings. This complex design increases the complexity of the missile and the cost of production, and thereby increases the likelihood of failure if the mechanism 300 does not perform as intended.

Figure 4:
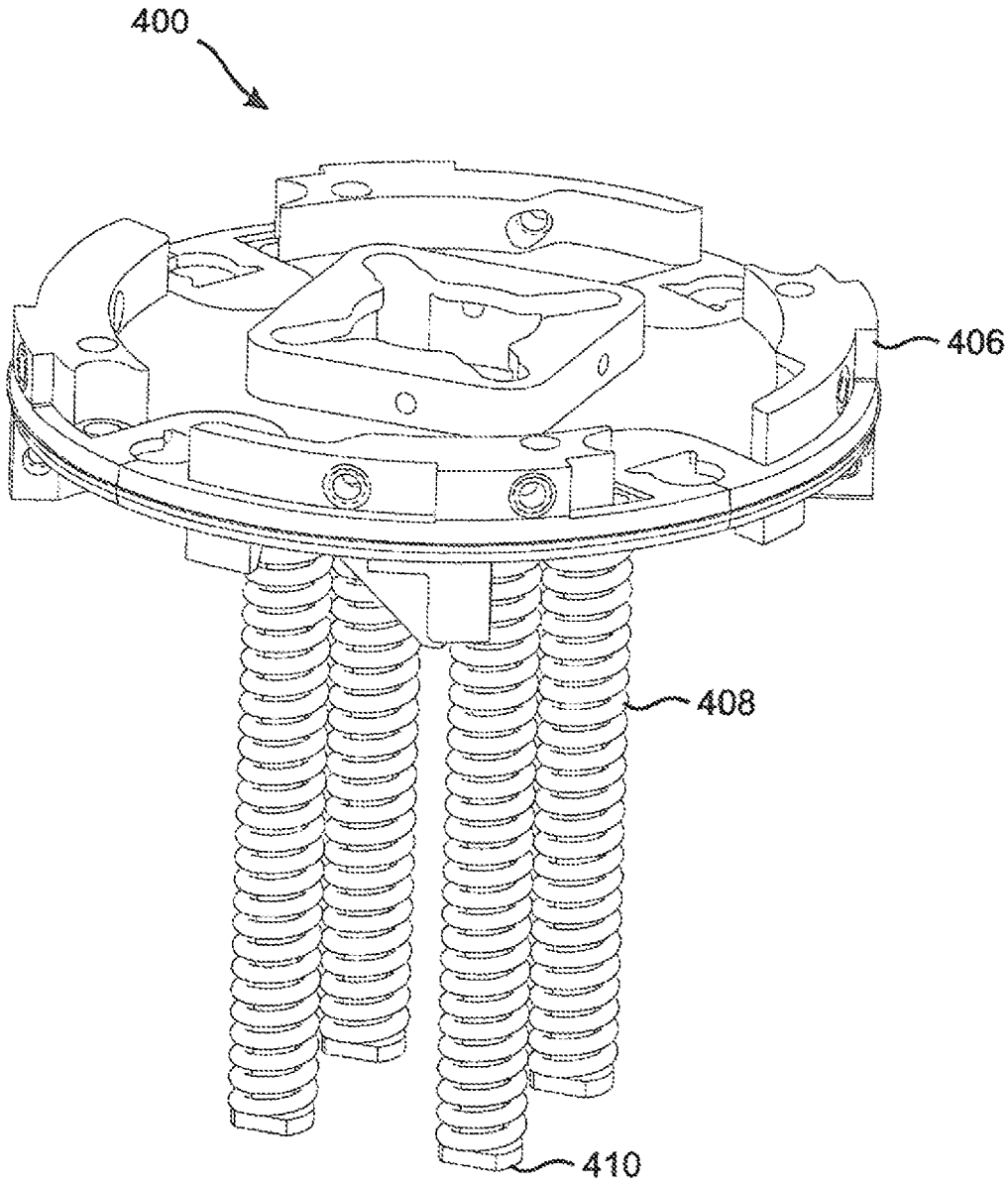
FIG. 4 is a perspective view from above of an embodiment of the present invention applicable to the APKWS missile, shown with the cam deployed.
Figure 5:
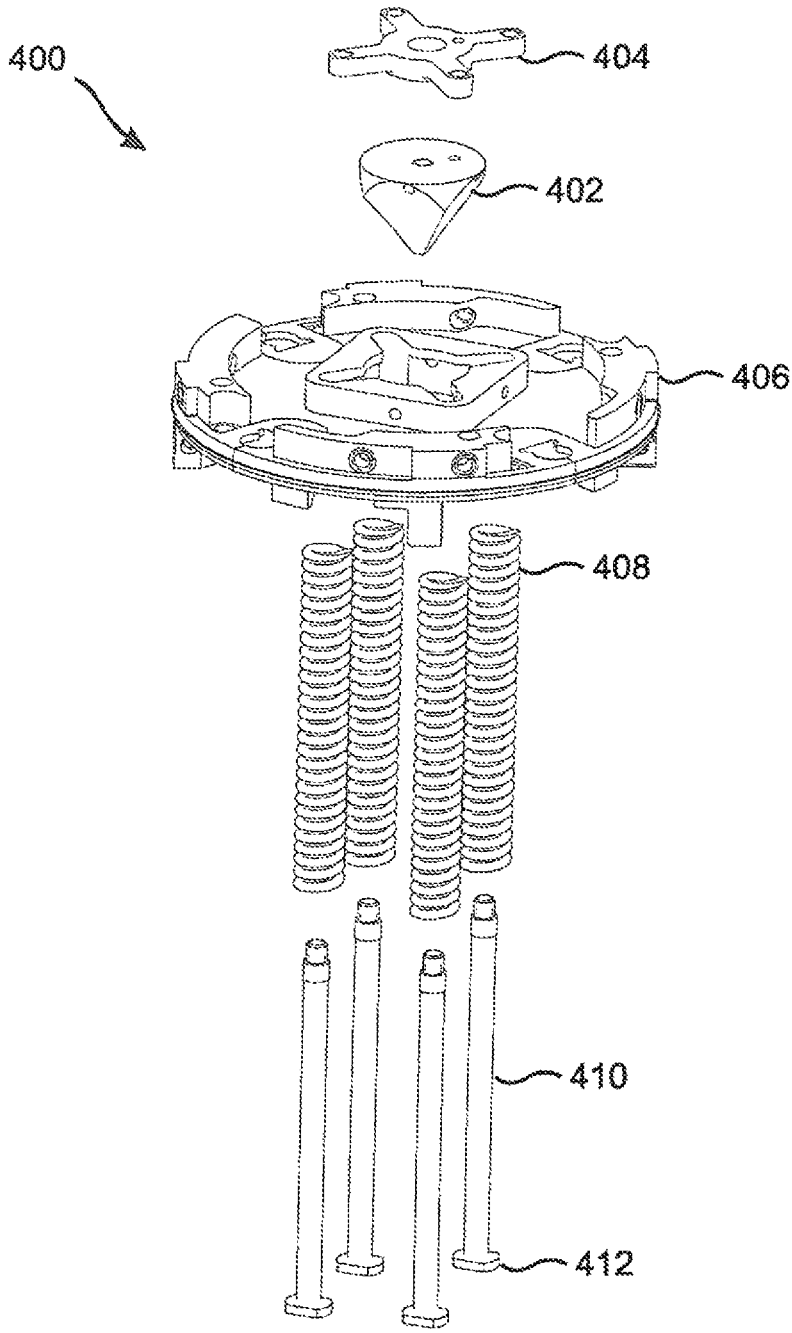
FIG. 5 is a perspective exploded view of the embodiment of FIG. 4.

The present invention provides enhanced wing deploy performance with reduced complexity, cost, and likelihood of failure. As illustrated in FIGS. 4 and 5, an embodiment 400 of the present invention directed to the APKWS includes only 13 parts, including a cam 402, a cam mount 404, an aft retainer assembled from a plate and two inserts 406, four compression springs 408 and four corresponding mandrels 410. The mandrels 410 pass through holes in the aft retainer 406 and attach to the cam mount 404 and thereby to the cam 402. When the wings 102 are stowed, the cam 402 and mandrels 410 are pushed up through openings in the aft retainer 406, thereby compressing the compression springs 408 between distal ends 412 of the mandrels 410 and the aft retainer 406. When the wings 102 are released, the compression springs 408 are able to push the mandrels and the cam 402 distally, so that the cam 402 passes through the aft retainer 406 and is driven between the wings 102, thereby forcing the wings apart and helping them to break through the frangible wing slot covers.

Several advantages are realized by this embodiment 400 as compared to the torsion spring mechanism 300 of FIG. 3:

- The embodiment illustrated in FIGS. 4 and 5 can exert 10 lb push force on each wing after 0.3 inches (2.5 degrees) of wing travel from its stowed position. By comparison, the embodiment 300 of the torsion spring wing deployment initiator of co-pending application 61/322,461 illustrated in FIG. 3B includes 65 components, and can exert only between 6 and 7 pounds of push force on each wing after 0.3 inches (2.5 degrees) of wing travel from its stowed position.
- The deployment force is delivered by linear compression springs 408, which provide considerably more energy than torsion springs 302 of similar size and weight. The present 400 design thereby provides more deployment energy than the torsion spring design 300 while using fewer and smaller springs 408.
- The deployment force in the present design 400 is delivered to all of the wings 102 by a single cam 402, thereby reducing the number of parts, the complexity, and the bulkiness of the wing deploy initiator 400 as compared to torsion spring design 300 which provide separate springs 302 for each wing 102.
- The deployment force is delivered at or near the ends of the guidance wings 102, thereby providing greater leverage than the torsion spring design 300, which applies a force at a location along the length of each wing 102.

Figure 6A:
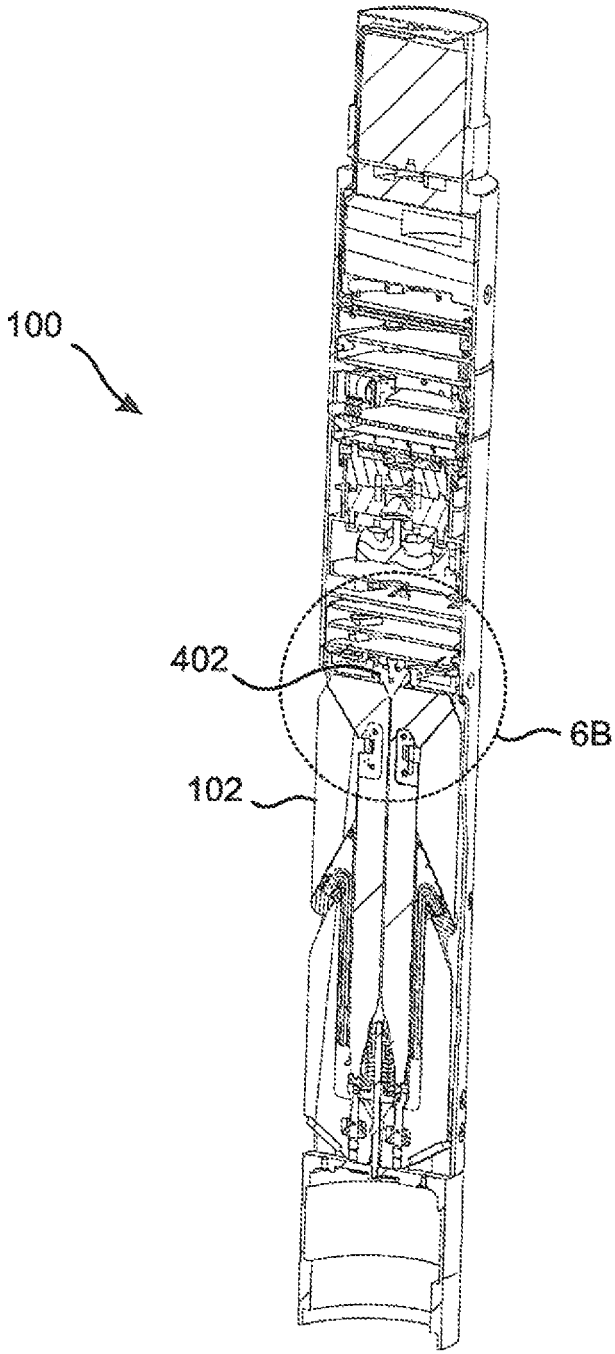
FIG. 6A is a perspective cut-away view of an APKWS missile showing the location of the embodiment of FIG. 4.
Figure 6C:
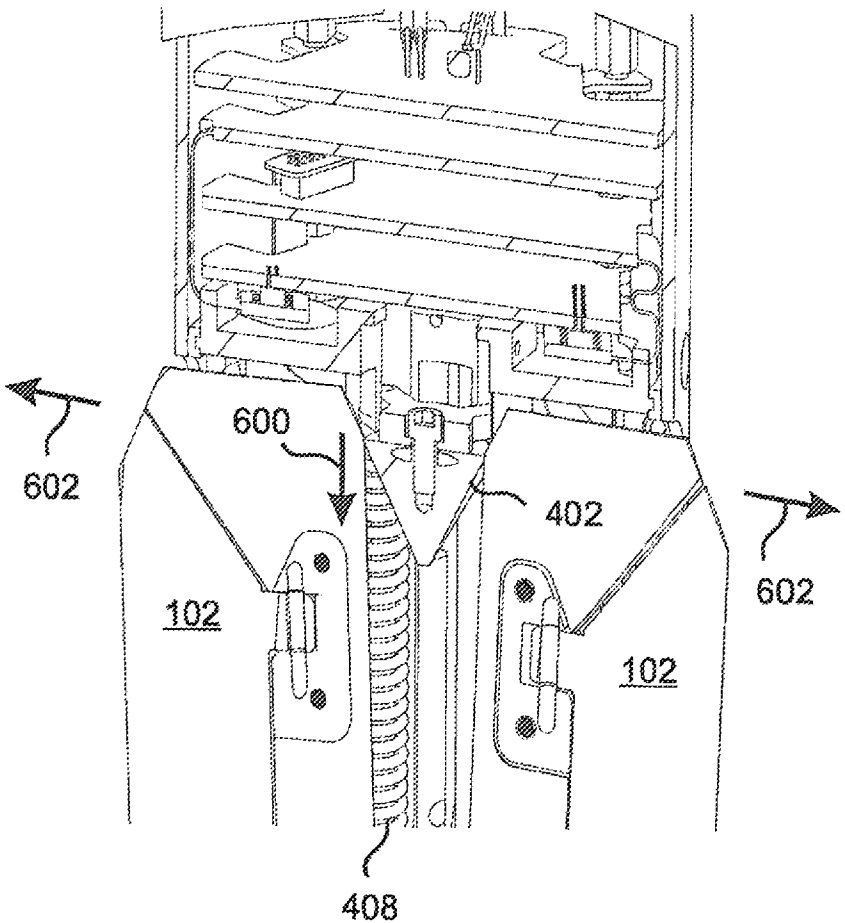
FIG. 6C is a close-up perspective cut-away view of the embodiment of FIG. 6A shown with the guidance wings partially deployed after actuation of the present invention.
Figure 6B:
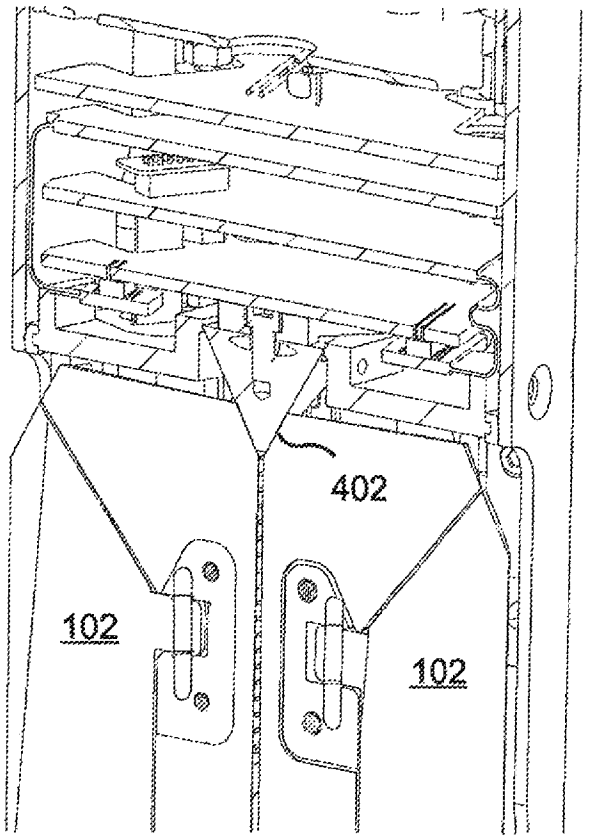
FIG. 6B is a close-up perspective cut-away view of the embodiment of FIG. 6A shown with the guidance wings in their locked and stowed configuration.

FIG. 6A is a perspective cut-away view of an APKWS missile 100 showing the guidance wings 102 in their stowed configuration with the cam 402 of the present invention positioned to push the wings 102 outward as the cam 402 is forced distally down between the wings 102. FIG. 6B is a close-up view of the tops of the wings 102 and the cam 402 of FIG. 6A, while FIG. 6C shows the close-up view of FIG. 6B after the cam 402 has moved distally downward 600 and the wings have moved outward 602.

Figure 7:
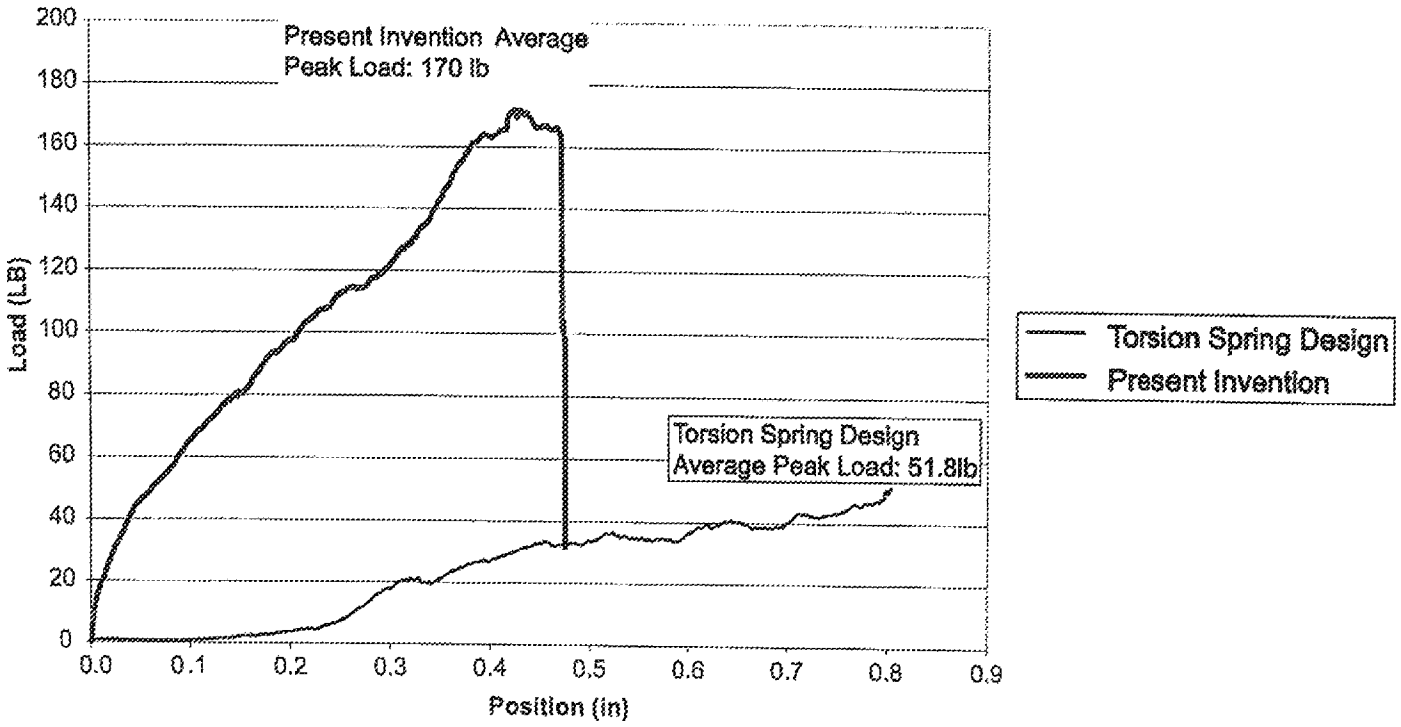
FIG. 7 presents some test results comparing spring force for the embodiment of FIG. 4 with the torsion spring initiator of FIG. 3A.

FIG. 7 presents some test data which document the improved spring force delivered by the embodiment of FIG. 4 as compared to the torsion spring design of FIG. 3. Note that the data includes not only the spring forces but also other system forces such as friction.

FIGS. 8A through 13B are detailed illustrations of the individual components which are included in two embodiments of the present invention. FIGS. 8A through 8D are illustrations of the assembled aft retainer plate and inserts of the first of these embodiments. FIG. 9A is a perspective view of the assembled aft retainer plate and inserts of the second of these embodiments. FIGS. 9B through 9M are illustrations of the aft retainer plate of the second embodiment without the inserts. FIGS. 10A through 13B are views of other components of the two embodiments which are applicable to either of them.

Figure 8A:
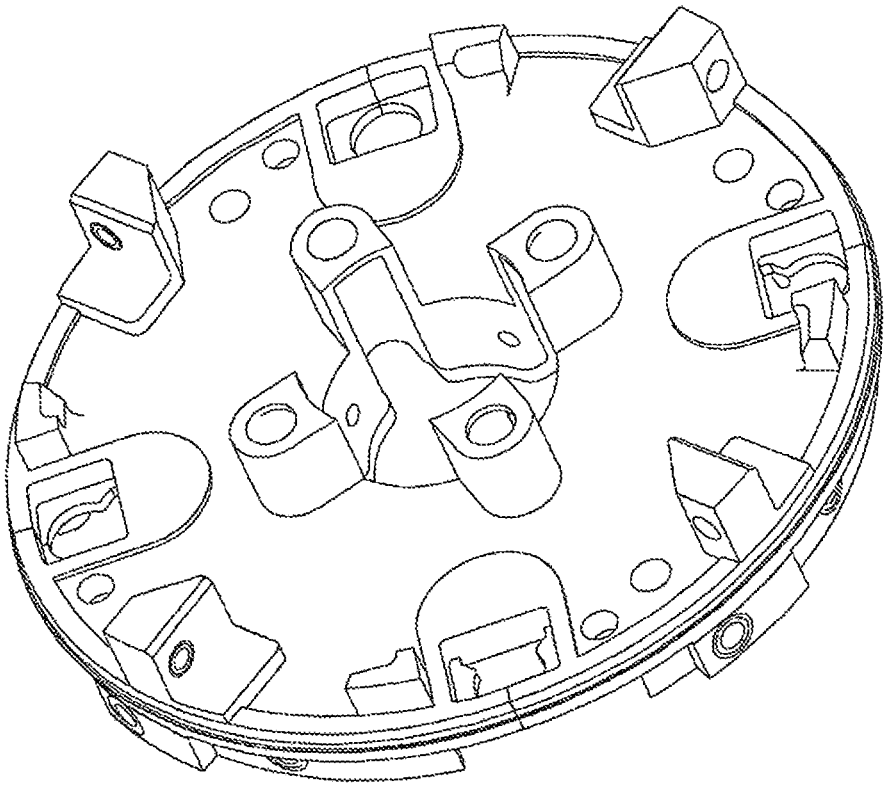
FIG. 8A is a perspective view from above of an assembled aft retainer assembly of an embodiment of the present invention.
Figure 8B:
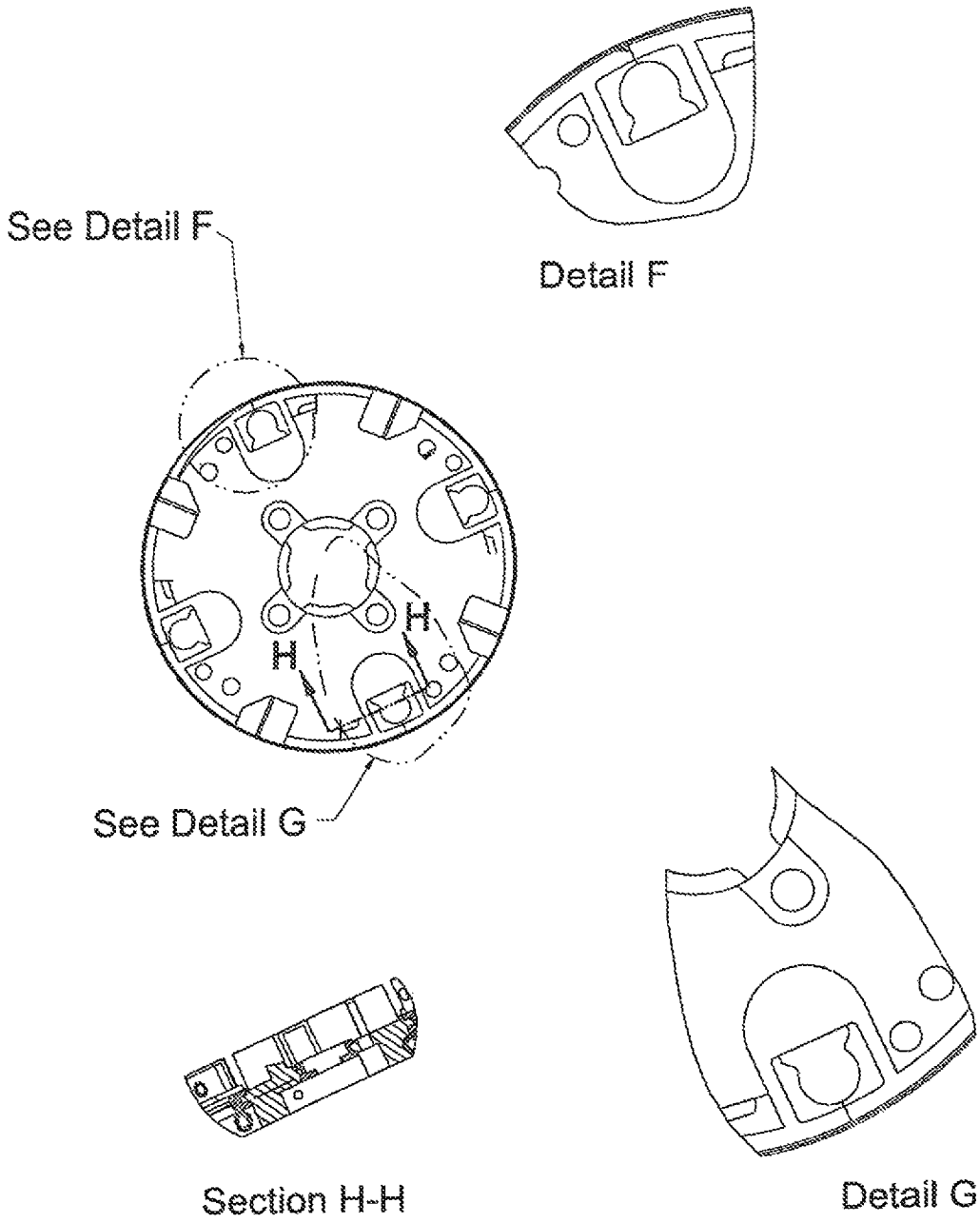
FIG. 8B is a top view of the aft retainer assembly of FIG. 8A.
Figure 8C:
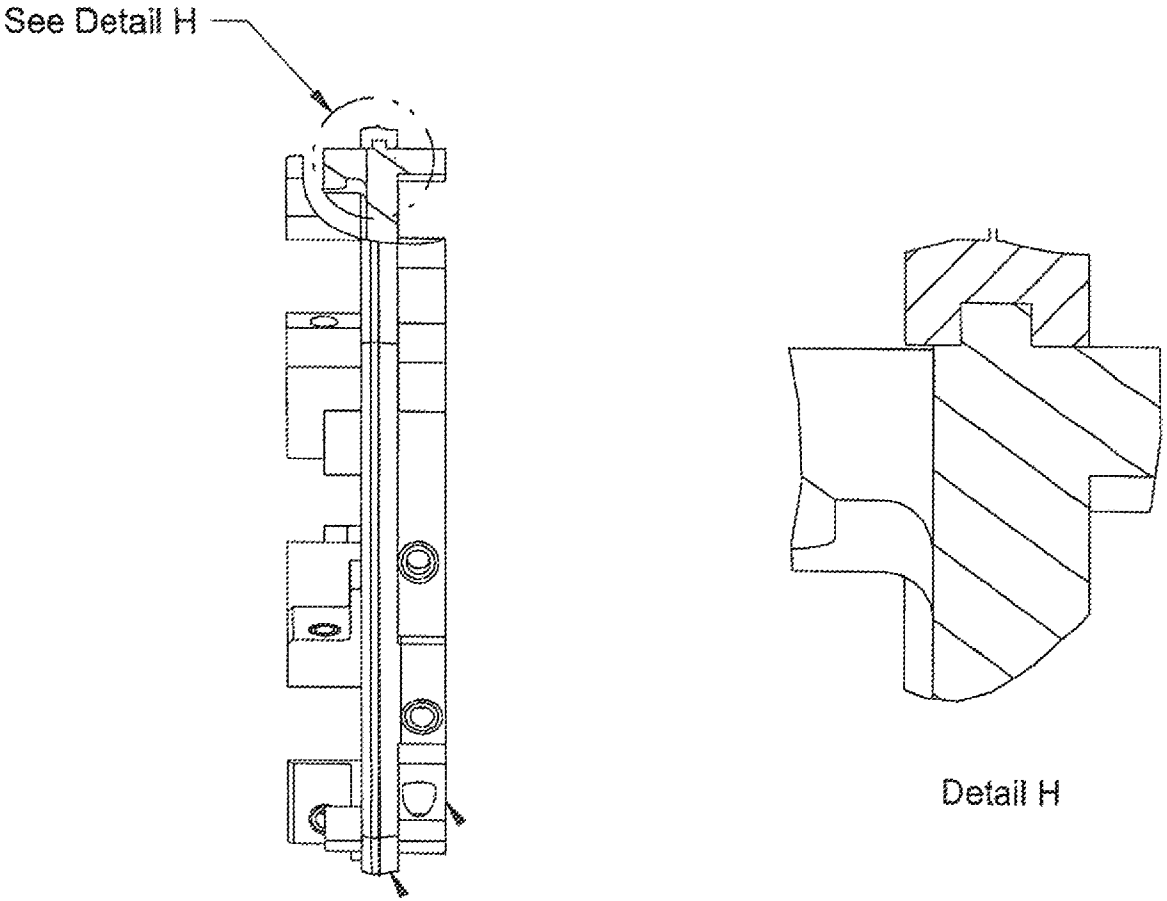
FIG. 8C is a side view of the aft retainer assembly of FIG. 8A.
Figure 8D:
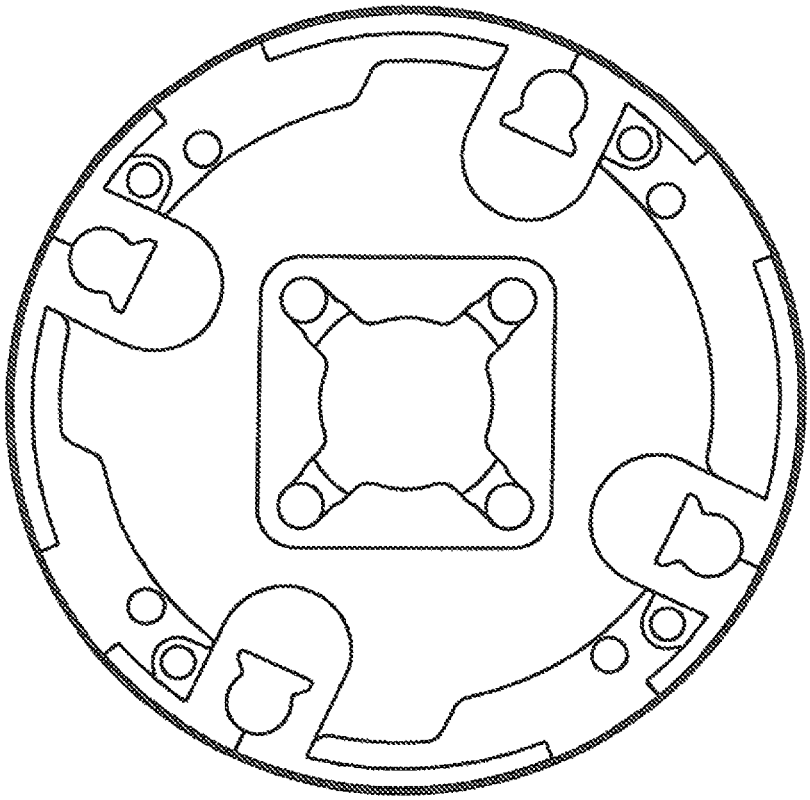
FIG. 8D is a bottom view of the aft retainer assembly of FIG. 8A.

Specifically, FIG. 8A is a perspective view from above of the assembled aft retainer assembly 406 of the first of the two embodiments. FIGS. 8B through 8D are top, side, and bottom view respectively of the aft retainer assembly 406 of FIG. 8A.

Figure 9B:
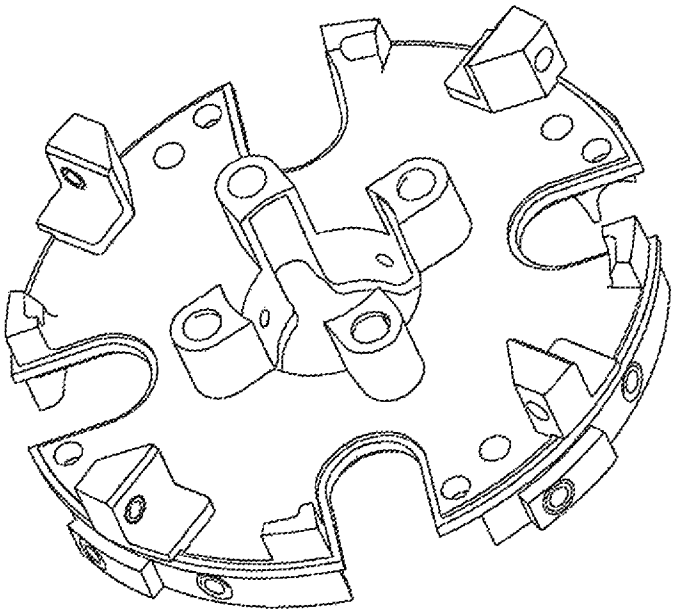
FIG. 9B is a perspective view from below of the aft retainer plate of FIG. 9A shown without the inserts.
Figure 9A:
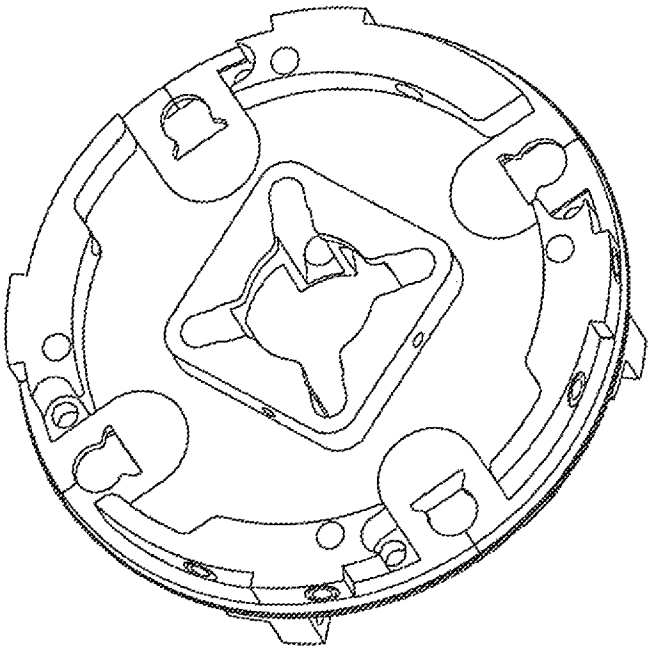
FIG. 9A is a perspective view from above of an assembled aft retainer assembly of an embodiment of the present invention which is similar to the embodiment of FIG. 8A.
Figure 9C:
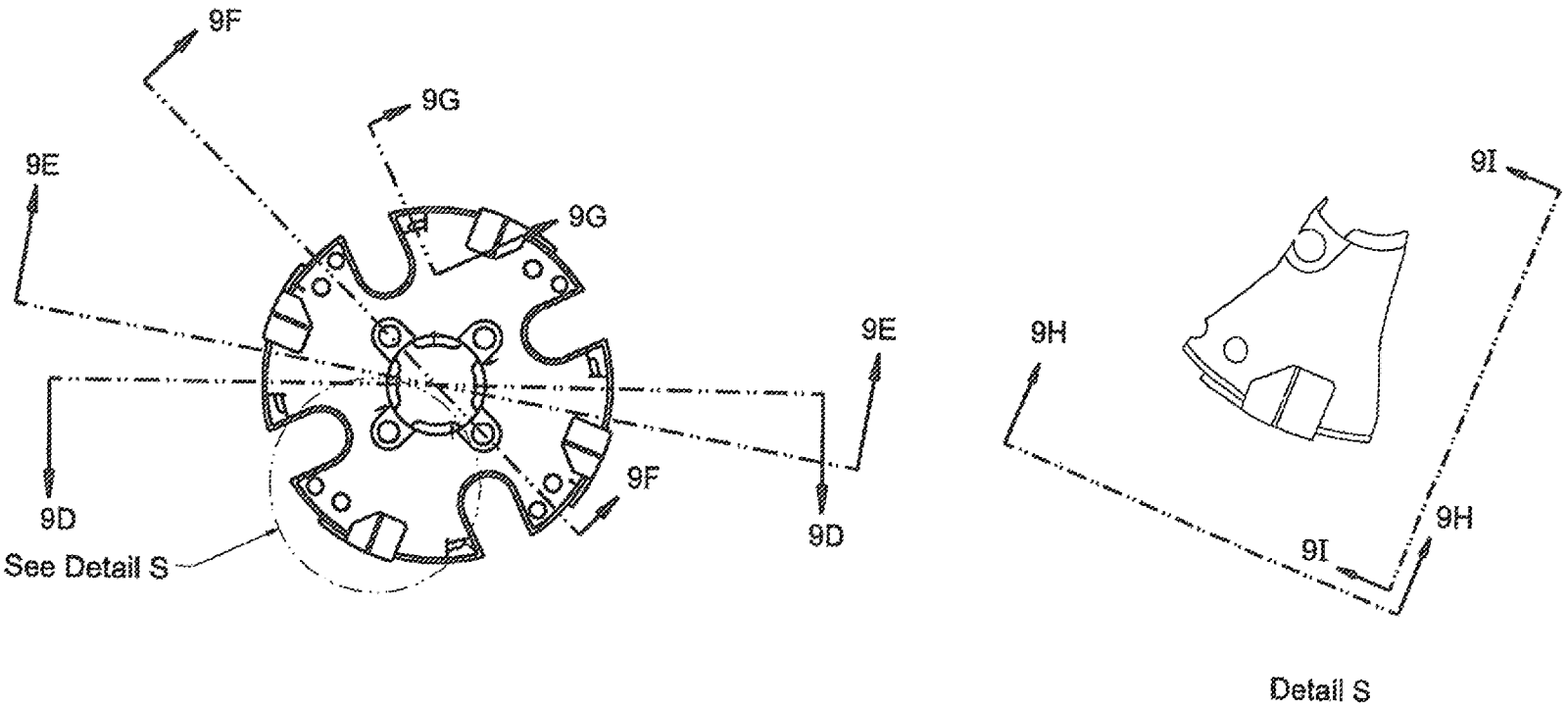
FIG. 9C is a top view of the aft retainer plate of FIG. 9B.
Figure 9D:
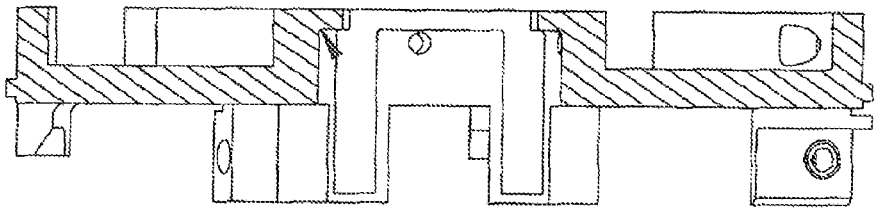
FIGS. 9D through 9I are cross sectional views of the aft retainer plate of FIG. 9B along axes indicated in FIG. 9C.
Figure 9E:
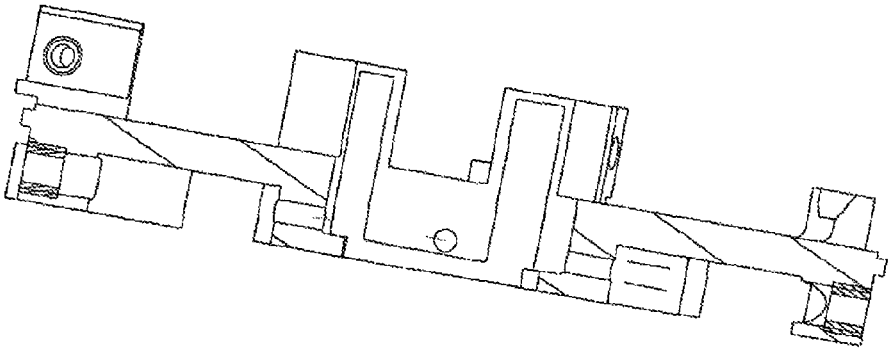
Figure 9F:
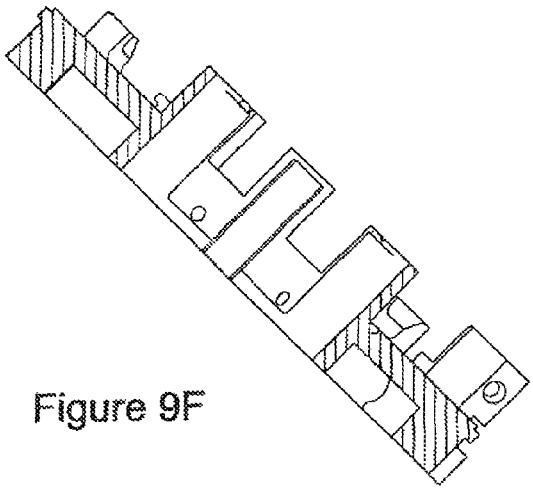
Figure 9G:
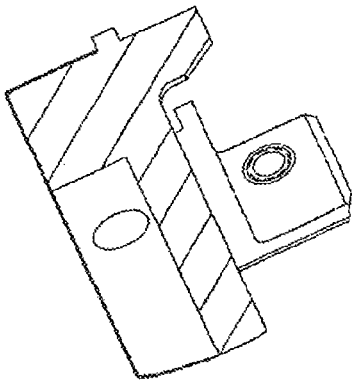
Figure 9I:
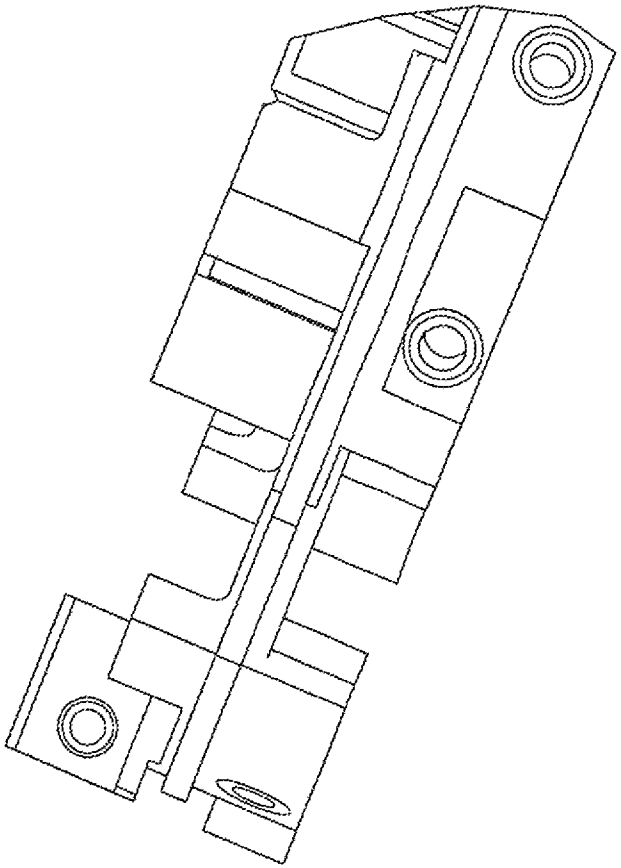
Figure 9H:
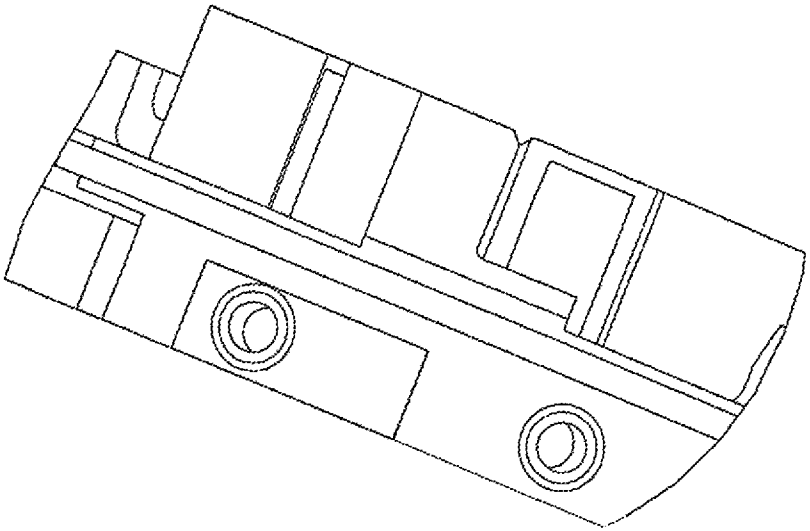
Figure 9L:
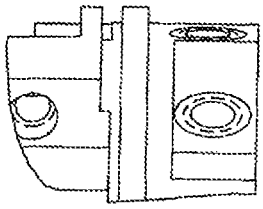
FIG. 9L is a cross sectional view of the aft retainer plate of FIG. 9B along an axis indicated in FIG. 9K.
Figure 9L:
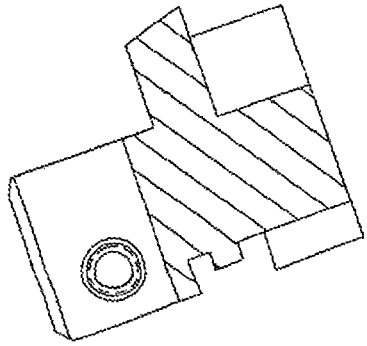
Figure 9J:
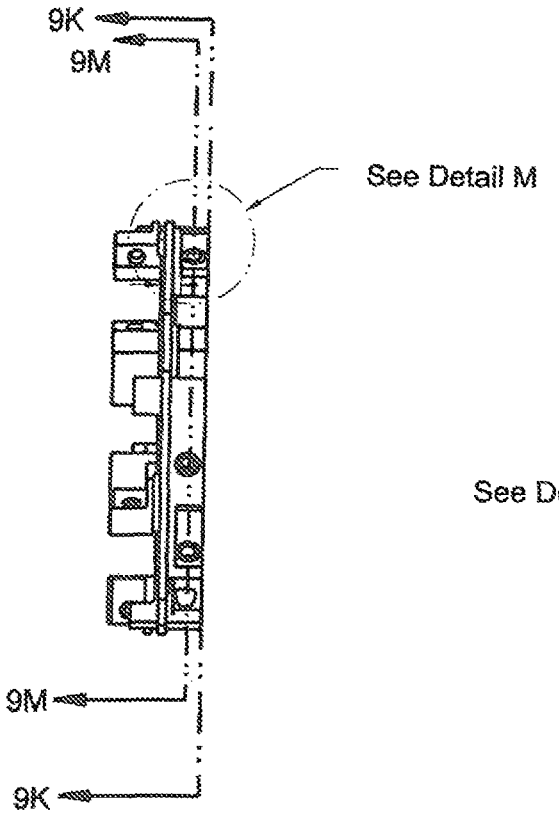
FIG. 9J is a side view of the aft retainer plate of FIG. 9B.
Figure 9K:
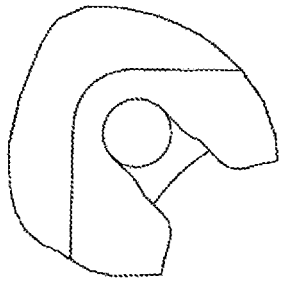
FIG. 9K is a bottom view of the aft retainer plate of FIG. 9B.
Figure 9K:
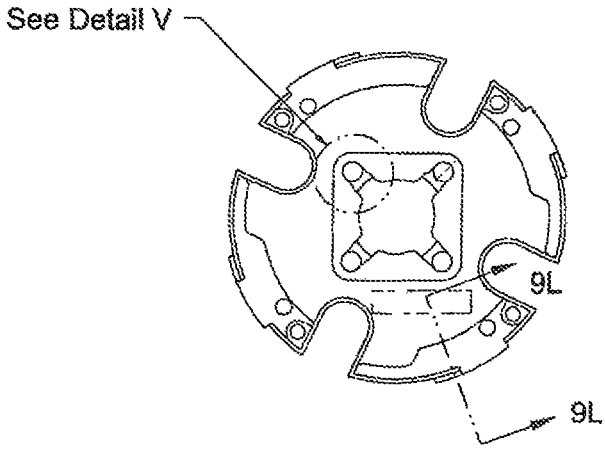
Figure 9M:
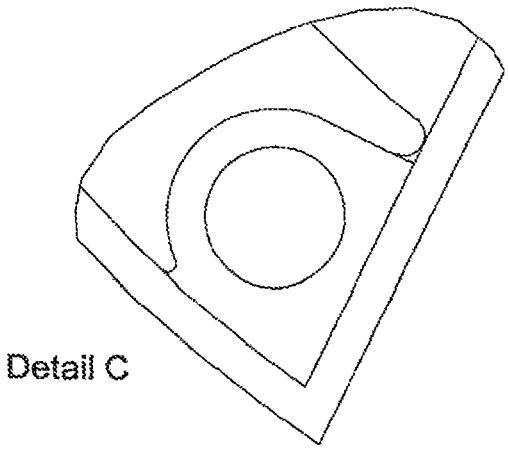
FIG. 9M is a cross sectional view of the aft retainer plate of FIG. 9B along an axis indicated in FIG. 9J.
Figure 9M:
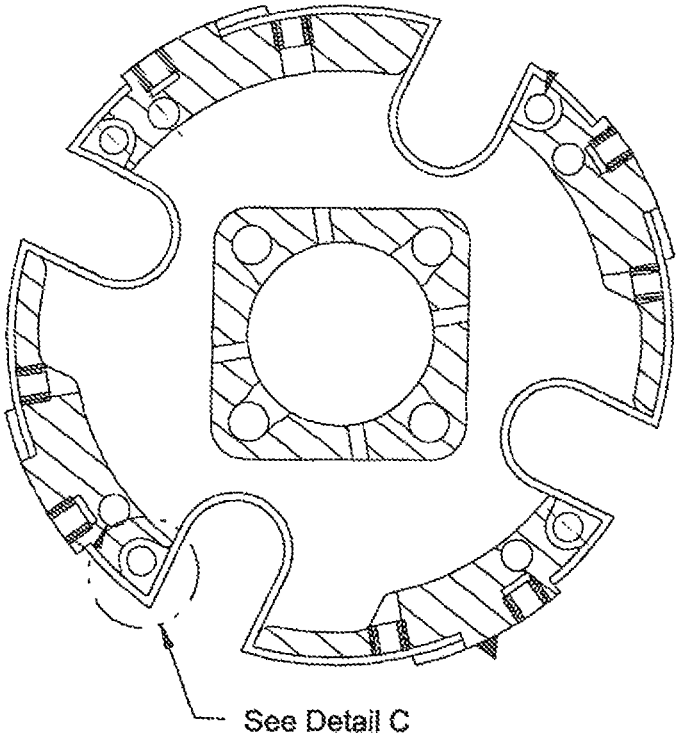

FIG. 9A is a perspective view from above of the assembled aft retainer assembly 406 of the second of the two embodiments, while FIG. 9B is a perspective view from below of the aft retainer plate of FIG. 9A shown without the inserts. FIG. 9C is a top view of the aft retainer plate of FIG. 9B. FIGS. 9D through 9I are cross sectional views of the aft retainer plate of FIG. 9B along axes indicated in FIG. 9C. FIG. 9J is a side view of the aft retainer plate of FIG. 9B. FIG. 9K is a bottom view of the aft retainer plate of FIG. 9B. FIG. 9L is a cross sectional view of the aft retainer plate of FIG. 9B along an axis indicated in FIG. 9K, and FIG. 9M is a cross sectional view of the aft retainer plate of FIG. 9B along an axis indicated in FIG. 9J.

Figure 10C:
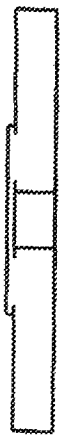
FIG. 10C is a side view of the cam mount of FIG. 10A.
Figure 10B:
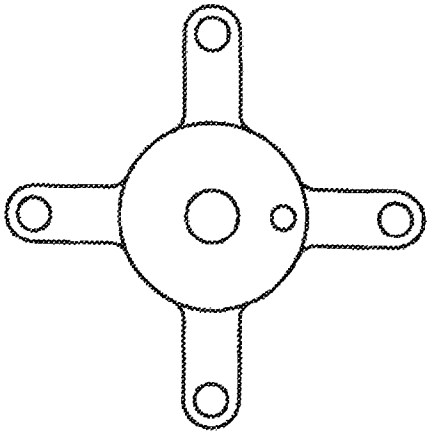
FIG. 10B is a top view of the cam mount of FIG. 10A.
Figure 10D:
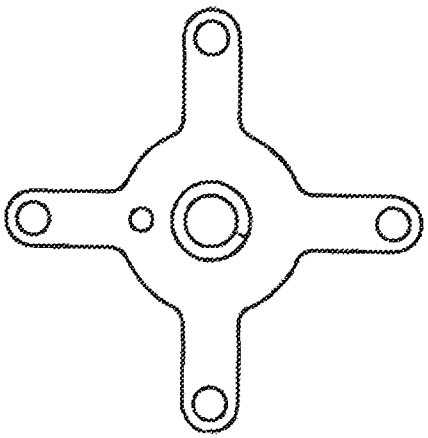
FIG. 10D is a bottom view of the cam mount of FIG. 10A.
Figure 10A:
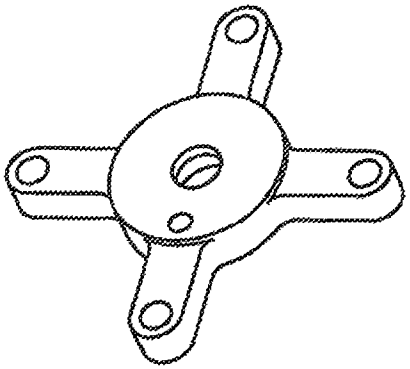
FIG. 10A is a perspective view from above of the cam mount of the embodiments of FIG. 8A and FIG. 9A.

FIG. 10A is a perspective view from above of the cam mount 404 of the embodiments of FIG. 8A and FIG. 9A, while FIGS. 10B through 10D are top, side, and bottom views respectively of the cam mount 404 of FIG. 10A.

Figure 11E:
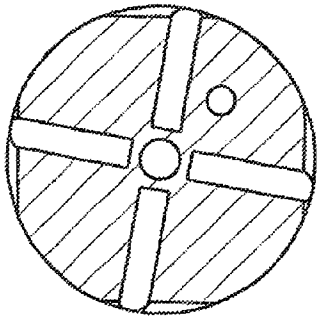
FIG. 11E is a cross sectional view of the cam of FIG. 11A along an axis indicated in FIG. 11D.
Figure 11D:
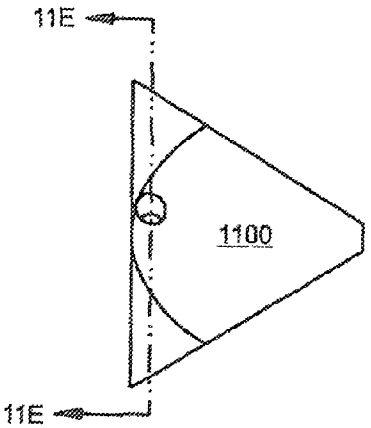
FIG. 11D is a side view of the cam of FIG. 11A.
Figure 11C:
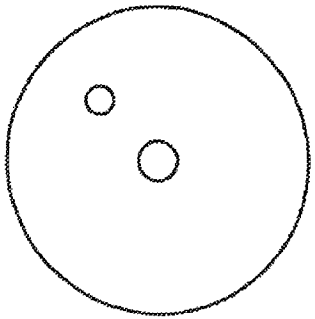
FIG. 11C is a top view of the cam of FIG. 11A.
Figure 11A:
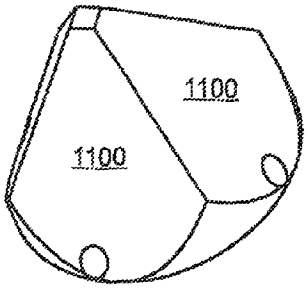
FIG. 11A is a perspective view from above of the cam of the embodiments of FIG. 8A and FIG. 9A.
Figure 11B:
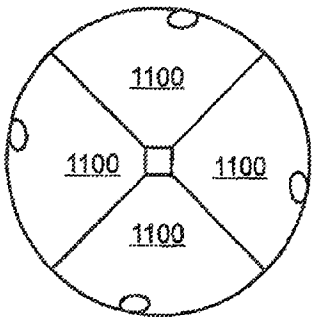
FIG. 11B is a bottom view of the cam of FIG. 11A.

FIG. 11A is a perspective view from above of the cam 402 of the embodiments of FIG. 8A and FIG. 9A, while FIGS. 11B through 11D are bottom, top, and side views respectively of the cam 402 of FIG. 11A, and FIG. 11E is a cross sectional view of the cam 402 of FIG. 11 A along an axis indicated in FIG. 11D. Note the oblique flat sides 1100 provided on the cam of FIGS. 11A through 11E, which is configured to be parallel to beveled edges 1902 provided on the ends of the guidance wings 102, as is discussed in more detail with reference to FIG. 19C.

Figure 13A:
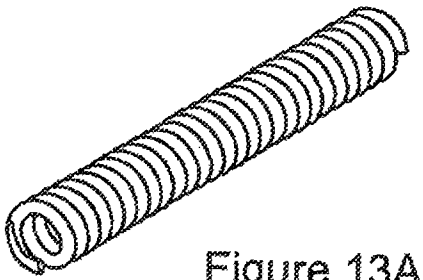
FIG. 13A is a perspective view from above of the compression springs of the embodiments of FIG. 8A and FIG. 9A.
Figure 13B:
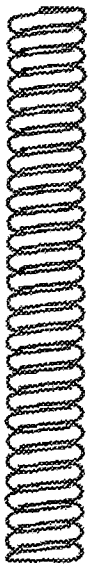
FIG. 13B is a side view of the compression spring of FIG. 13A.
Figure 12A:
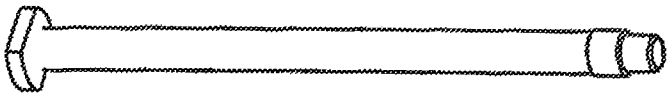
FIG. 12A is a perspective view from above of the mandrels of the embodiments. of FIG. 8A and FIG. 9A.
Figure 12B:
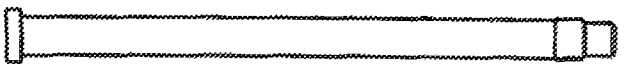
FIG. 12B is a side view of the mandrel of FIG. 12A.
Figure 12C:
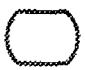
FIG. 12C is a bottom view of the mandrel of FIG. 12A.

FIG. 12A is a perspective view from above of a mandrel 410 of the embodiments of FIG. 8A and FIG. 9A, while FIGS. 12B and 12C are side and bottom views respectively of the mandrel 410 of FIG. 12A. FIG. 13A is a perspective view from above of a compression spring 408 of the embodiments of FIG. 8A and FIG. 9A, while FIG. 1313 is a side view of the compression spring 408 of FIG. 13A.

Figure 14:
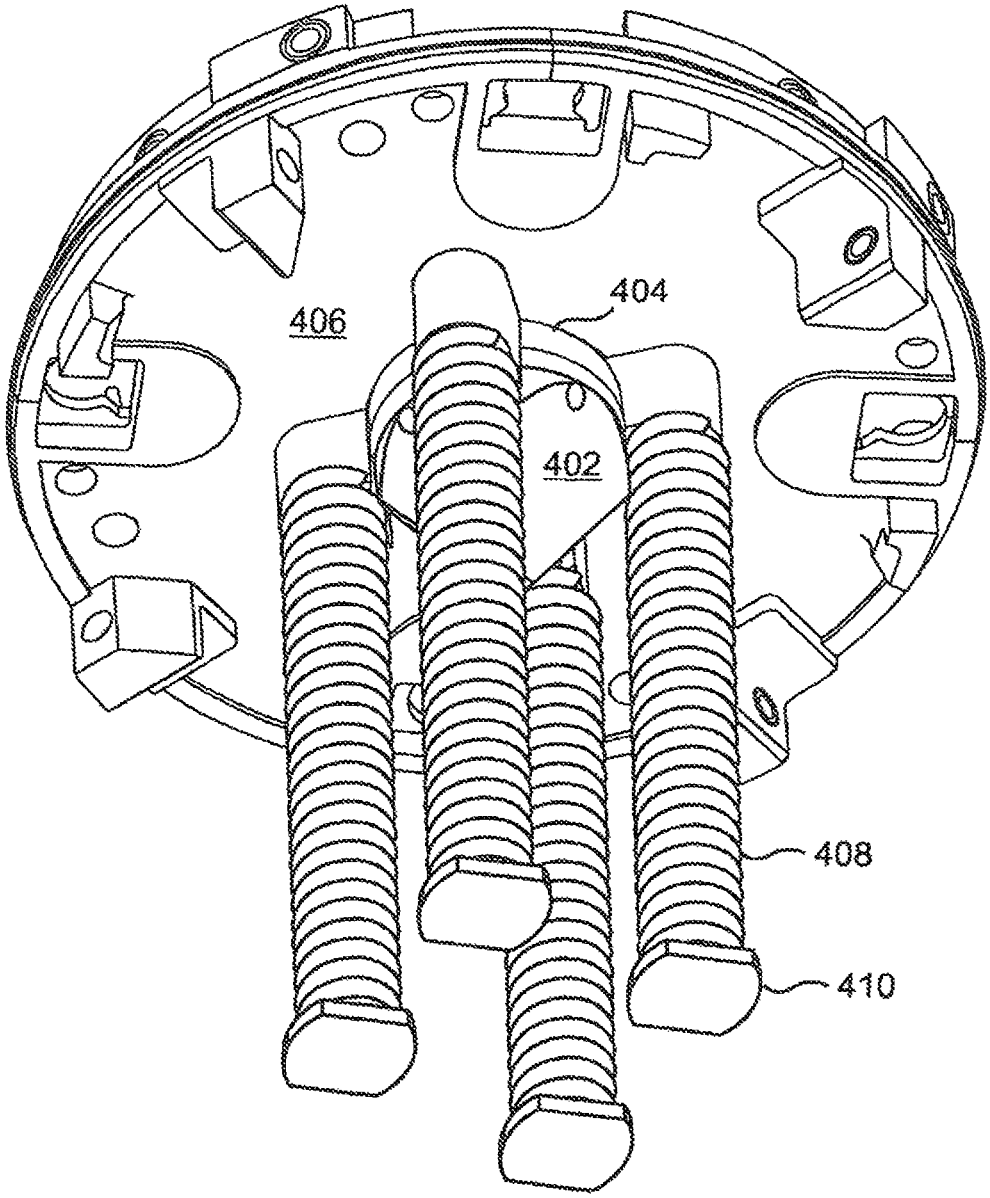
FIG. 14 is a perspective view from below of the embodiment of FIGS. 8A through 8D and 10A through 13B.

FIG. 14 is a perspective view from below of the assembled embodiment of FIGS. 8A through 8D and 10A through 1313.

Figure 15:
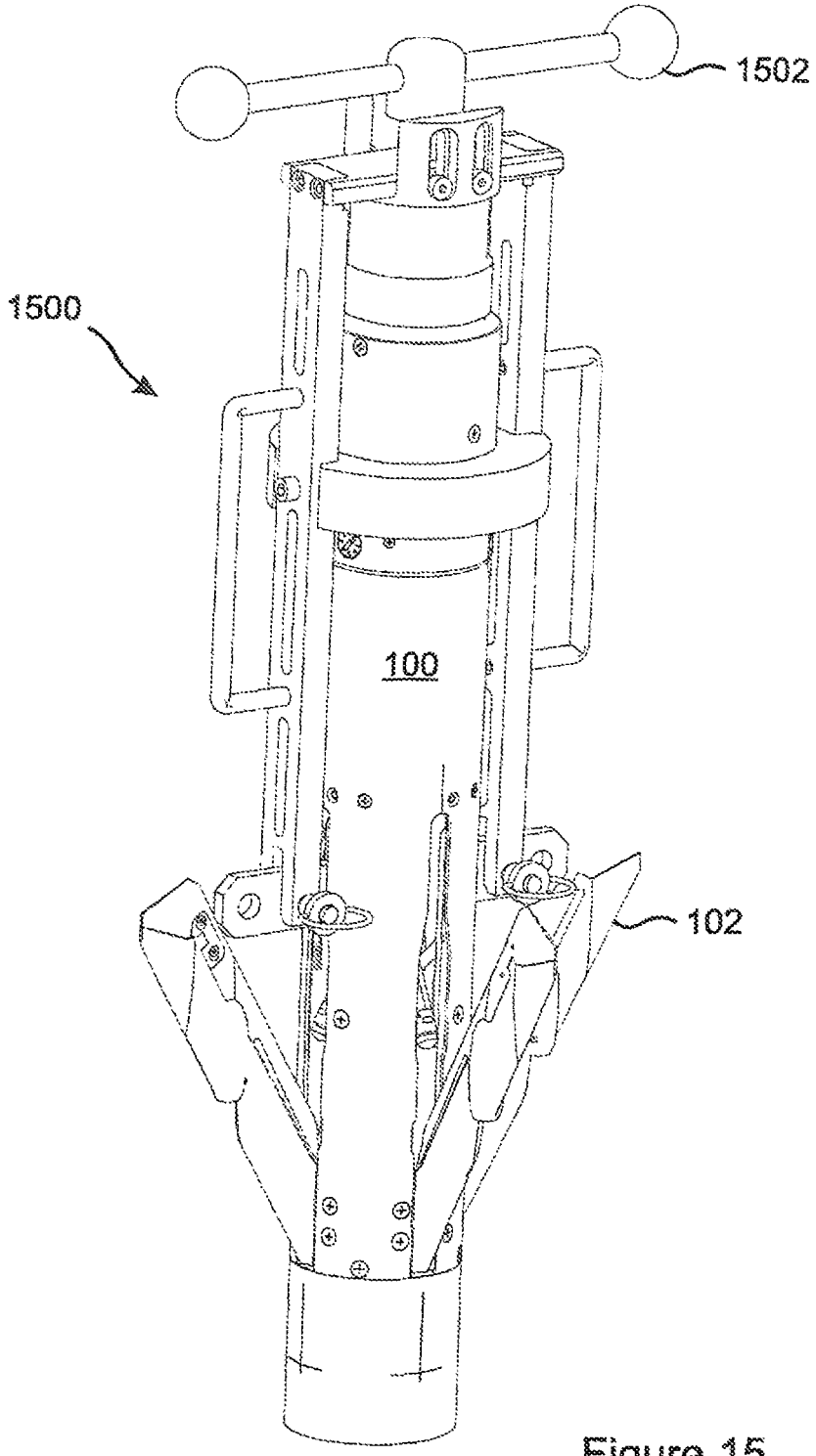
FIG. 15 is a perspective view of a device which is used to stow the guidance wings of an APKWS missile equipped with an embodiment of the present invention.

FIG. 15 is a perspective view of an apparatus 1500 used for stowing the guidance wings in an APKWS equipped with an embodiment of the present invention. A section of the missile 100 is installed in the apparatus 1500, and a handle is turned to drive the cam 402 up to its pre-launch position. A temporary retaining pin (not shown) is then installed through the aft retaining assembly 406 and through the cam 402 to hold the cam 402 in place against the tension of the springs 408. At this point, the missile 100 can be removed from the apparatus 1500, and the wings 102 can be stowed, after which the temporary retaining pin can be removed and a covering screw can be installed in the hole from which the pin was removed.

Figure 16:
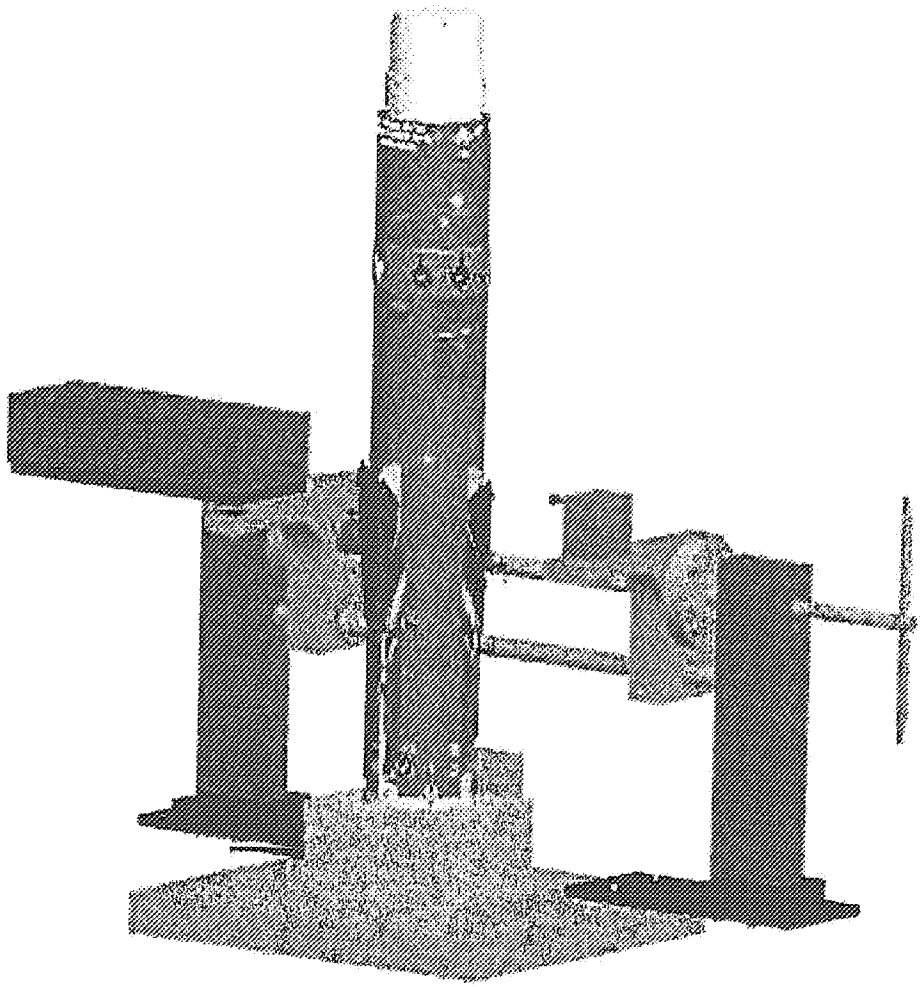
FIG. 16 is a perspective view of a test configuration by which spring forces were measured in obtaining the data of FIG. 7.
Figure 18:
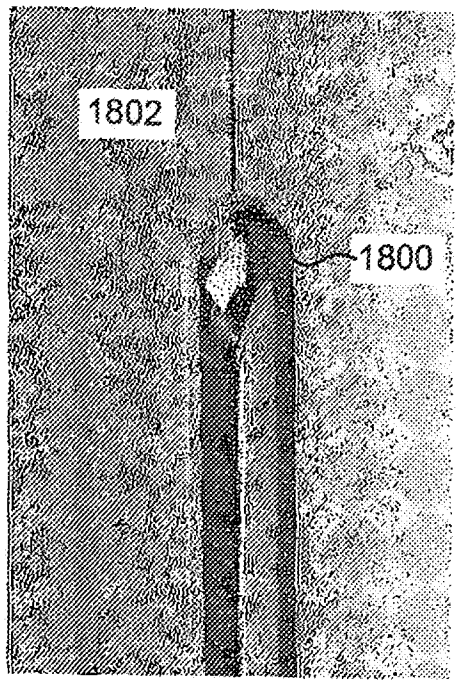
FIG. 18 is a close-up perspective view from the side showing the tip of a guidance wing stowed within a wing slot of an APKWS missile.
Figure 17:
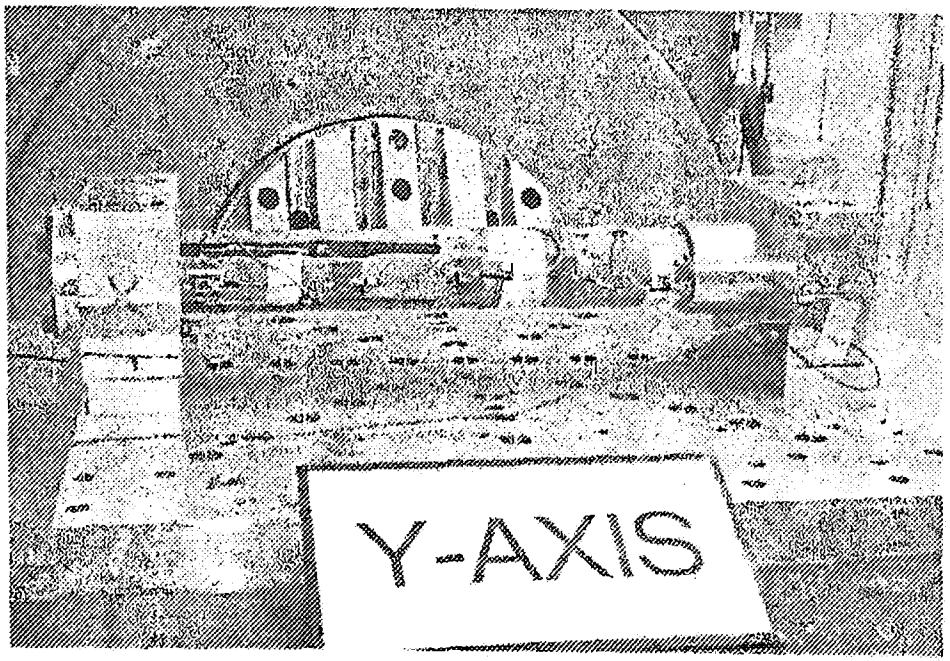
FIG. 17 is a perspective view of a test configuration whereby the embodiment of FIG. 4 was tested for resistance to vibration and shocks.

FIG. 16 is a perspective view of a spring force measurement fixture which was used to obtain the data of FIG. 7. FIG. 17 is a perspective view of a test configuration which was used to evaluate the resistance of the embodiment to vibration and shocks. FIG. 18 is a close-up view showing the end of a guidance wing 102 stowed within a wing slot 1800 in the fuselage 1802 of a missile 100. The wing slot cover has been omitted from the figure for clarity of illustration.

Figure 19A:
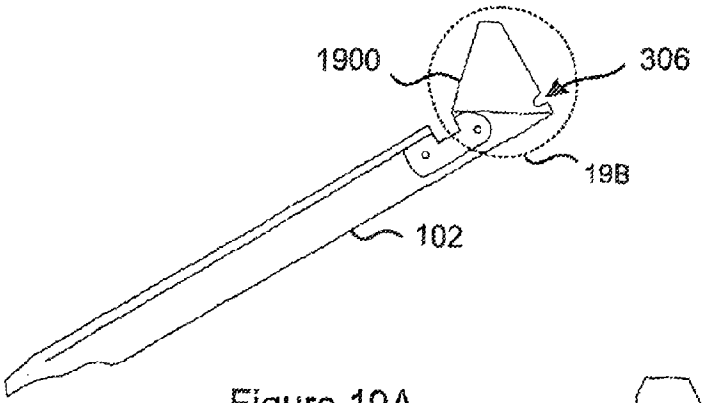
FIG. 19A is a side view of a guidance wing configured for use with the torsion spring deploy assist device of FIG. 3B.
Figure 19C:
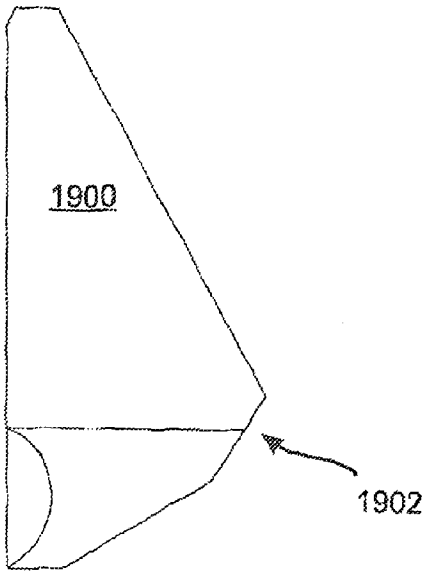
FIG. 19C is a close-up view of the tip of a guidance wing configured for use with the embodiment of FIG. 4 of the present invention.
Figure 19B:
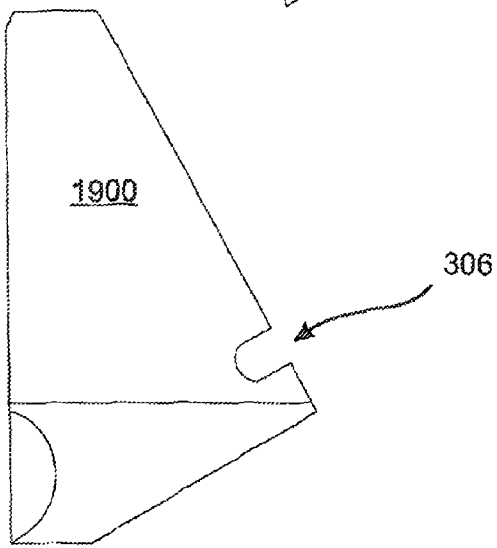
FIG. 19B is a close-up side view of the tip of the guidance wing of FIG. 19A, showing a notch used to secure the wing in the stowed configuration.

With reference to FIG. 19A, the guidance wings 102 of missiles 100 such as the APKWS typically include variable pitch "flaperons" 1900 which are used to control the direction of flight of the missile. In the case of the APKWS, it is the flaperons 1900 which are engaged in retaining the guidance wings 102 in their folded and stowed configuration. FIG. 19B is a close-up view of the flaperon region of a guidance wing used with the torsion spring design of FIG. 3. FIG. 19C illustrates a modification 1902 to the flaperons 1900 of the APKWS wings 102 which is a beveled edge 1902 compatible with the oblique sides 1100 of the cam 402 of the present invention. As illustrated in FIGS. 6B and 6B, this enables the cam 402 to apply a distributed pressure to the ends of the guidance wings 102 during deployment.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A wing deploy initiator for initiating deployment from a stowed configuration of a plurality of guidance wings of a rocket or missile, the guidance wings being hinged at distal ends thereof so as to pivot outward during wing deployment through corresponding wing slots provided in a fuselage of the rocket or missile, proximal ends of the guidance wings being located in mutual proximity within the fuselage when the guidance wings are in the stowed configuration, the wing deploy initiator comprising:

a cam, the cam being too large to pass between the guidance wings when the guidance wings are in the stowed configuration; and at least one compression spring, the compression spring being configured to drive the cam distally between the guidance wings, the cam thereby forcing the guidance wings to pivot apart from each other and outward through the wing slots.

2. The wing deploy initiator of claim 1, wherein the cam includes a plurality of flat surfaces oriented at oblique angles relative to a longitudinal axis of the rocket or missile, the flat surfaces being oriented so that each of the flat surfaces maintains contact with a corresponding one of the guidance wings as the cam is driven distally between the guidance wings.

3. The wing deploy initiator of claim 2, wherein the flat surfaces of the cam are configured so as to be substantially parallel to beveled edges provided on the corresponding guidance wings, the flat surfaces of the cams thereby making parallel contact with the beveled edges of the corresponding guidance wings as the cam is driven distally between the guidance wings.

4. The wing deploy initiator of claim 1, wherein each of the compression springs surrounds a mandrel and is retained between a distal end of the mandrel and a retainer plate, a proximal end of the mandrel being able to pass through an opening in the retainer plate so as to compress the compression spring against the retainer plate, the cam being attached to the plurality of mandrels.

5. The wing deploy initiator of claim 4, wherein the cam is attached to the mandrels near the proximal ends of the mandrels.

6. The wing deploy initiator of claim 5, wherein the cam is able to pass through an opening in the retainer plate as the proximal ends of the mandrels pass through the retainer plate.

7. The wing deploy initiator of claim 6, further comprising a cam mount attaching the cam to the proximal ends of the plurality of mandrels, the cam mount being unable to pass fully through the retainer plate, the cam mount thereby preventing removal of the mandrels from the retainer plate.

8. The wing deploy initiator of claim 1, wherein the guidance wings are maintained in the stowed configuration by a wing retaining mechanism, the guidance wings thereby preventing the distal movement of the cam until the wing retaining mechanism is released so that the guidance wings can be driven outward by the distal movement of the cam.

9. The wing deploy initiator of claim 1, wherein the wing deploy initiator is configured for use with an guided missile.

10. The wing deploy initiator of claim 1, wherein the wing deploy initiator consists of a total of 13 parts.

11. The wing deploy initiator of claim 1, wherein the wing deploy initiator is able to exert at least 10 lb of push force on each wing after 0.3 inches (2.5 degrees) of wing travel from each wing's stowed position.

12. The wing deploy initiator of claim 1, wherein the wing deploy initiator is able to exert sufficient push force on each wing to cause each wing to break through a frangible cover installed over the corresponding wing slot.

* * * * *